US005728038A

United States Patent [19]

Coffey et al.

[11] Patent Number: 5,728,038

[45] Date of Patent: Mar. 17, 1998

[54] CENTRIFUGE ROTOR HAVING STRUCTURAL STRESS RELIEF

[75] Inventors: Robert G. Coffey, Campbell; Dean A. Hanquist, Palo Alto; Patrick Q. Moore, Gilroy; Terence T. Lung, Sunnyvale, all of Calif.

[73] Assignee: Beckman Instruments, Inc., Fullerton, Calif.

[21] Appl. No.: 845,679

[22] Filed: Apr. 25, 1997

[51] Int. Cl.[6] ..... B04B 5/02

[52] U.S. Cl. ..... 494/16

[58] Field of Search ..... 494/12, 16, 20, 494/33, 81, 85; 74/572, 573 R, 574

[56] References Cited

U.S. PATENT DOCUMENTS

| | | | |
|---|---|---|---|
| 4,449,965 | 5/1984 | Strain | 494/16 |
| 4,484,906 | 11/1984 | Strain | 494/16 |
| 4,586,918 | 5/1986 | Cole | 494/20 |
| 4,738,656 | 4/1988 | Piramoon et al. | 494/16 X |
| 4,781,669 | 11/1988 | Piramoon | 494/16 |
| 4,804,100 | 2/1989 | Müller et al. . | |
| 4,817,453 | 4/1989 | Breslich, Jr. et al. . | |
| 4,832,679 | 5/1989 | Bader | 494/16 |
| 5,362,300 | 11/1994 | Christensen | 494/16 |
| 5,362,301 | 11/1994 | Malekmadani et al. | 494/16 |
| 5,382,219 | 1/1995 | Malekmadani | 494/16 |
| 5,533,644 | 7/1996 | Glen et al. . | |
| 5,562,583 | 10/1996 | Christensen . | |

*Primary Examiner*—Charles E. Cooley

*Attorney, Agent, or Firm*—William H. May; P. R. Harder; Thomas Schneck

[57] ABSTRACT

A centrifuge rotor with a body having a spin axis and a plurality of bores formed therein, each of which is adapted to support a centrifuge container. The rotor includes a load reducing feature to decrease the loading between the rotor body and the centrifuge container, during centrifugation. The load reducing feature includes separating a portion of an annular shoulder of a centrifuge container from the rotor body. The portion of the annular shoulder that is separated is disposed between the spin axis and the bore associated with the centrifuge container.

20 Claims, 4 Drawing Sheets

CENTRIFUGE ROTOR HAVING STRUCTURAL STRESS RELIEF

DESCRIPTION

1. Technical Field

The present invention pertains to the field of centrifugation. Specifically, the present invention pertains to a centrifuge rotor ideally suited for use with removable sample-holding centrifuge containers.

2. Background Art

Centrifuges are commonly used in medical and biological industries for separating and purifying materials of differing densities, such as viruses, bacteria, cells and proteins. A centrifuge includes a rotor and a container to support a sample undergoing centrifugation. The rotor is designed to hold the sample container while it spins at up to tens of thousands of revolutions per minute.

Two requirements for the high capacity centrifuge rotor and sample container have historically been in conflict: strength and weight. That is, the centrifuge rotor and sample container must have the requisite strength to resist forces associated with centrifugation and should be manufactured from the lightest weight materials available.

Attempts to reduce the mass of centrifuge rotors prompted the introduction of fiber reinforced centrifuge rotors and sample containers. These devices are stronger and lighter than steel rotors, providing a much smaller moment of inertia and higher maximum speeds than non-fiber reinforced rotors and sample containers. U.S. Pat. No. 5,533,644 to Glen et al. and U.S. Pat. application Ser. No. 08/438,899 to Baum et al., both of which are assigned to the assignee of the present application, disclose a hybrid centrifuge container providing a durable lightweight sample holder capable of being machined to close tolerances. The container includes a fiber reinforced base having an open end and a closed end, with a metal sleeve attached to the open end.

U.S. Pat. No. 5,562,583 to Christensen discloses, in pertinent part, a shell-type centrifuge rotor having a sample container support sleeve extending through a cavity in a plate. The sleeve has at least two slots which define at least one resilient flange pivotally deflectable about a pivot axis. In this fashion, the sleeve is held in a fixed relationship with respect to the plate. In one embodiment, both slots extend axially along the sleeve. In an alternate embodiment, one of said slots extends axially along the sleeve with the remaining slot extending circumferentially about the sleeve.

U.S. Pat. No. 5,382,219 to Malekmadani discloses a fixed angle all composite centrifuge rotor including a plurality of tube holders equally spaced about the circumference of the rotor. Each of the tube holders is formed from a plurality of helically and circumferentially wound layers of fiber material dipped in an epoxy matrix.

U.S. Pat. No. 5,362,301 to Malekmadani et al. discloses a fixed angle all composite centrifuge rotor. The rotor includes a plurality of blind cell holes equally spaced about the circumference of the rotor, with reinforcement cups placed therein. The cups are formed of a plurality of helically wound fibers which are dipped in an epoxy matrix.

U.S. Pat. No. 4,586,918 to Cole discloses a centrifuge rotor having a load transmitting arrangement. The arrangement consists, in pertinent part, of a pair of substantially wedge shaped members disposed in a circumferentially spaced relationship, defining a region therebetween, adapted to accommodate a sample container support housing assembly therein. Each wedge shaped member has an abutment thereon which is adapted to engage a conforming circumferentially flared surface on the sample container support housing assembly. The wedges cooperate with each other to interact with the housing assembly to transmit centrifugal forces to the stress confining enclosure at locations spaced from the localized region to thereby more uniformly load the enclosure.

An object of the present invention is to provide a rotor capable of operating at higher speeds with prior art centrifuge containers, without decreasing the containers' operational life, by reducing the load concentration therebetween during centrifugation.

A further object of the present invention is to provide a centrifuge container capable of operating at higher speeds with prior art centrifuge rotor systems by reducing the load concentration therebetween during centrifugation.

SUMMARY OF THE INVENTION

These objectives have been achieved by providing a centrifuge rotor with a body having a spin axis and a plurality of bores formed therein, each of which is adapted to support a centrifuge container, and includes a load reducing feature to decrease the loading between the rotor body and the centrifuge container, during centrifugation. The present invention is based upon the discovery that a locus of the load between the centrifuge container and the rotor body is located on an area of the rotor body proximate to the bore, between the spin axis and the centrifuge container. Specifically, the rotor body has first and second opposed major surfaces and a plurality of bores formed into the first major surface and extending toward the second major surface. The centrifuge container includes a shoulder adapted to seat proximate to an area of the first surface, surrounding one of the plurality of bores, defining a load bearing surface. In one embodiment, the load reducing feature consists of a recess formed into the load bearing surface proximate to the locus, forming a void therebetween.

In a second embodiment, the load reducing feature consists of beveling the load bearing surface to have a frusto-conical shape. The shoulder of the centrifuge container has a profile complementary to the frusto-conical load bearing surface. The centrifuge container has a second cross-sectional area smaller than that of the bore, thereby allowing the centrifuge container to move therein to form a gap between the shoulder and the load bearing surface, during centrifugation.

In a third embodiment, the load reducing feature includes a recess formed into the shoulder of the centrifuge container, forming a void between the shoulder and the load bearing surface.

BEST MODE FOR CARRYING OUT THE INVENTION

Figure 1:
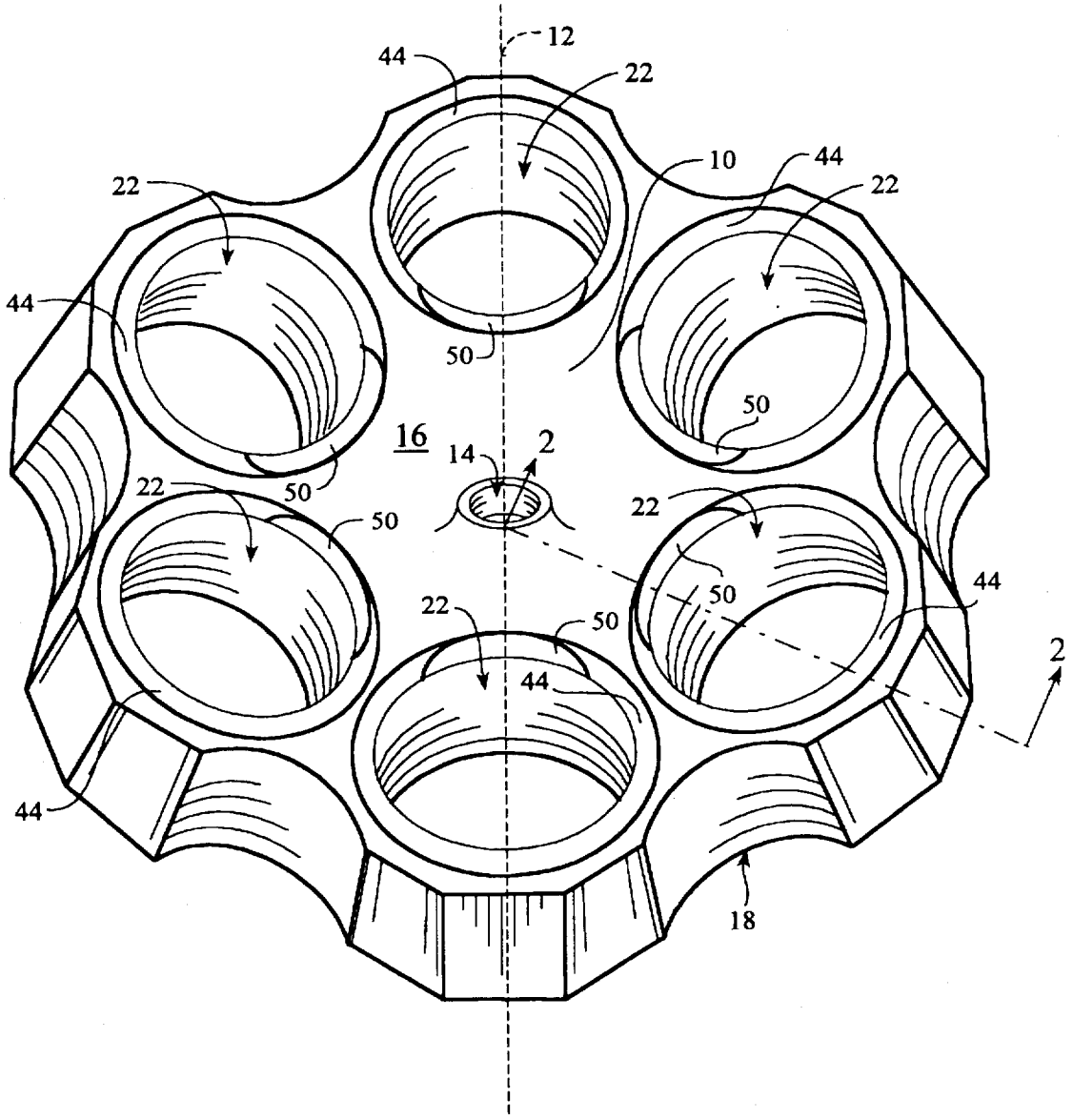
FIG. 1 is a perspective view of a centrifuge rotor, in accord with the present invention.

With reference to FIG. 1, a centrifuge rotor includes a body 10 provided with a central hole 14, disposed around a spin axis 12, for mounting the rotor on an associated drive shaft (not shown). The body 10 may be formed from any suitable material, such as aluminum, titanium or wound fiber tow. The body 10 includes first and second opposed major surfaces 16 and 18, shown more clearly in FIG. 2. Referring again to FIG. 1, a plurality of bores 22 are formed in the first major surface 16. The plurality of bores 22 may be oriented, with respect to the spin axis, so as to define either a fixed-angle or vertical tube centrifuge rotor. For ease of discussion, a fixed-angle centrifuge rotor is discussed. The plurality of bores 22 are disposed radially symmetric about the spin axis 12 and extend toward the second major surface 18. Although six bores 22 are shown, any number of bores 22 may be provided.

Figure 2:
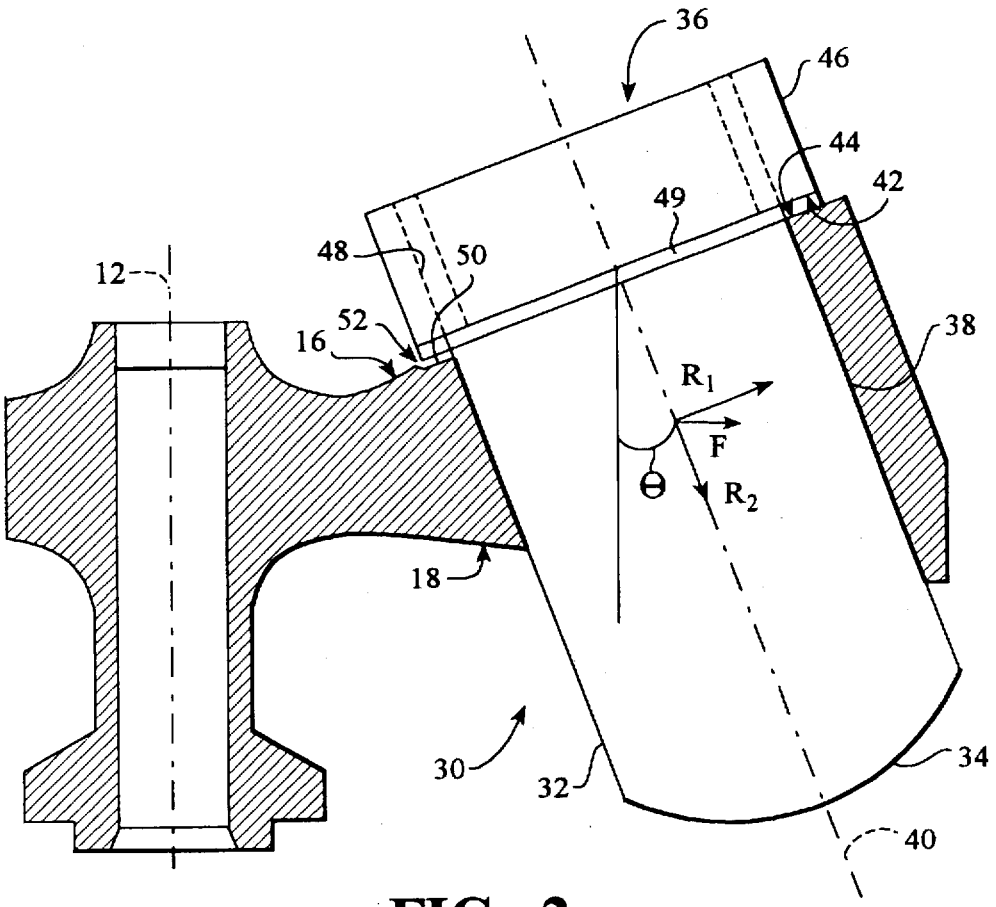
FIG. 2 is a plan view, in partial cross-section, of the rotor body shown in FIG. 1.

Referring to both FIGS. 1 and 2, each of the bores 22 have a cross-sectional area complementary to a cross-sectional area of a centrifuge container 30 to be disposed therein. Typically, the centrifuge container 30 is of the of the type having a receptacle 32 with a closed end 34 and an open end 36, located opposite to the closed end 34. Although the receptacle 32 may have any cross-sectional area desired, it is preferred that the receptacle 32 have a circular cross-section defined by a cylindrical wall 38 extending along a lengthwise axis 40, between the closed end 34 and the open end 36, and includes an annular shoulder 42 disposed near the open end 36. The shoulder 42 is adapted to seat against an annular area of the first surface 16, surrounding one of the plurality of bores 22, upon reaching a final seating position therewith, defining a load bearing surface 44. In the final seating position, the open end 36 of the receptacle 32 extends from the first major surface 16, with the closed end 34 disposed near the second major surface 18.

During centrifugation, a centrifugal force $\bar{F}$ acts upon the receptacle 30 and its contents. In a fixed-angle rotor where the lengthwise axis 40 forms the angle $\Theta$ with respect to a spin axis 12, the force $\bar{F}$ can be resolved into two components $R_1$ and $R_2$. The component $R_1$ acts normal to the cylindrical wall 38, and $R_2$ acts parallel to the cylindrical wall 38. The $R_2$ component causes a tensile stress that tends to pull the receptacle parallel to the lengthwise axis 40 and may overcome the shear strength of the materials from which the interface 48 is formed. The $R_2$ component proves problematic with hybrid composite centrifuge containers.

The receptacle 32 of a hybrid centrifuge container is typically formed from a resin impregnated wound fiber-composite base. The shoulder 42 is formed from one edge of the metal sleeve 46 into which the receptacle 32 is fitted and permanently adhered thereto using a suitable adhesive. A problem encountered with the hybrid centrifuge containers concerns delamination of the metal sleeve 46 from the receptacle 32. Specifically, the force component $R_2$ tends to drive the receptacle 32 downwardly toward the second major surface 18 and outwardly away from the spin axis 12. Resistance to this movement is provided by the interface between the shoulder 42 and the load bearing surface 44, which causes the metal sleeve 46 to delaminate from the receptacle 32 at an inner region of the sleeve-receptacle indicated at region 48. It was discovered that the reaction due to the component $R_2$ was concentrated at the inner region 48, compared to the remaining regions of the sleeve-receptacle interface. It is believed that this is due, in part, to the distortion of the rotor body 10, as well as to the receptacle 32 cantilevering within the bore 22. Specifically, the $R_1$ component moves the closed end 34 outwardly away from the spin axis 12, with the receptacle 32 deforming slightly as a result thereof. This focuses the load between the shoulder 42 and the load bearing surface 44 at a locus 50 disposed between the receptacle 32 and the spin axis 12. The load at the locus 50 is transmitted to the inner region 48 of the sleeve-receptacle interface, causing the sleeve 46 and the receptacle 32 to delaminate.

To avoid delamination, the locus 50 of load bearing surface 44 is recessed, thereby forming a void 52 between the shoulder 42 and rotor body 10. The void 52 relieves the load placed on the shoulder 42, thereby reducing the stresses present at the inner region 48 of the sleeve-receptacle interface. A compression washer 49 may be disposed between the shoulder 42 and the load bearing surface 44 to further distribute the load therebetween, shown more clearly in FIG. 2. As discussed above, load bearing surface 44 typically has an annular shape. As a result, the void 52 subtends a portion of the circumference of load bearing surface 44, that is defined by an angle in the range of 30° to 60°, which is bisected by an imaginary line extending radially from the spin axis. The width of the locus 50, measured parallel to a direction radial with respect to the spin axis 12, is at least as large as the depth of the shoulder 42, measured normal to the cylindrical wall 38.

Figure 3:
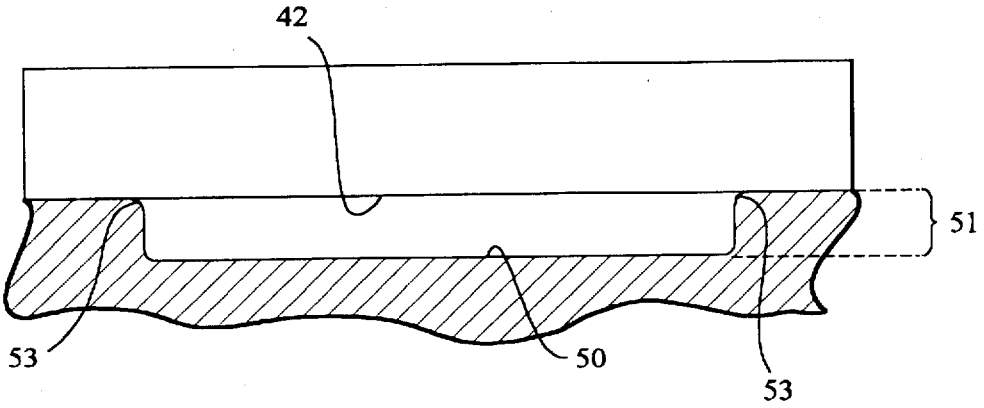
FIG. 3 is a detailed view of a load reducing feature shown in FIG. 1 in accord with the present invention.
Figure 4:
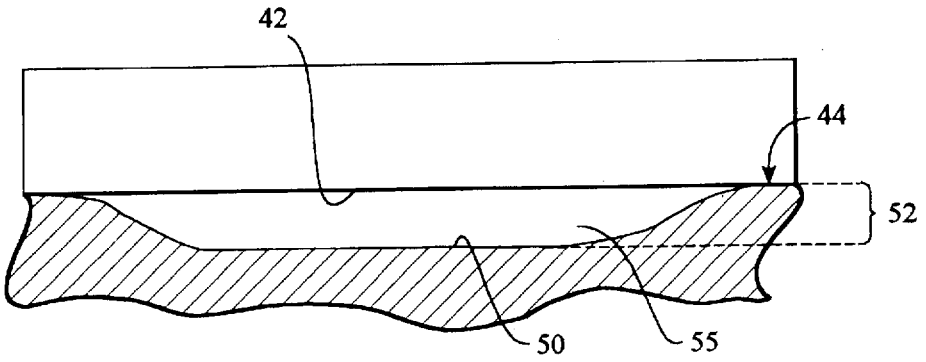
FIG. 4 is a detailed view of a load reducing feature shown in FIG. 1 in accord with an alternate embodiment of the present invention.

The void 52 may be formed by creating a step 51 in the locus 50 of the load bearing surface, having two well-defined spaced-apart shoulders 53, shown in FIG. 3. Alternatively, the void 52 may be formed by creating an arcuate recess 55 at the locus 50 characterized by having a smooth transition between the locus 50 and the remaining area of the load bearing surface 44, shown in FIG. 4.

Figure 5:
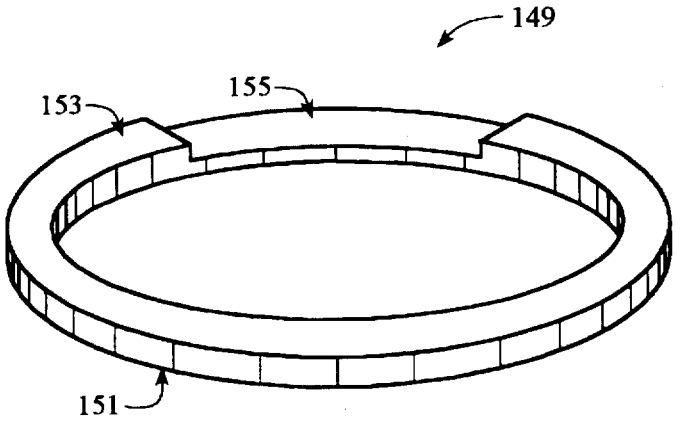
FIG. 5 is a perspective view of a washer having a recess disposed in one of the major surfaces, in accord with an alternate embodiment of the present invention.

Referring to FIGS. 1 and 5, the void 52 may also be formed by providing a washer 149 having opposed major surfaces 151 and 153, one of which includes a recess 155. As surface 151 is substantially planar, it would be disposed to face the first major side 16 of the rotor 10. Surface 153, which includes the recess 155, would face the shoulder 42. The washer 149, however, would be orientated to place the recess 155 between the spin axis 12 and the bore 22. In this fashion, the void 52 may be provided with existing centrifuge containers and rotors by using the inexpensive washer 149. This avoids the expensive undertaking of having to machine a recess into an existing rotor or specially manufacturing a new rotor to include such a recess. Regardless of how the void is formed, a portion of annular shoulder 42 subtending between 30° and 60° of the shoulder 42's circumference is spaced-apart from the load bearing surface 44.

Figure 6A:
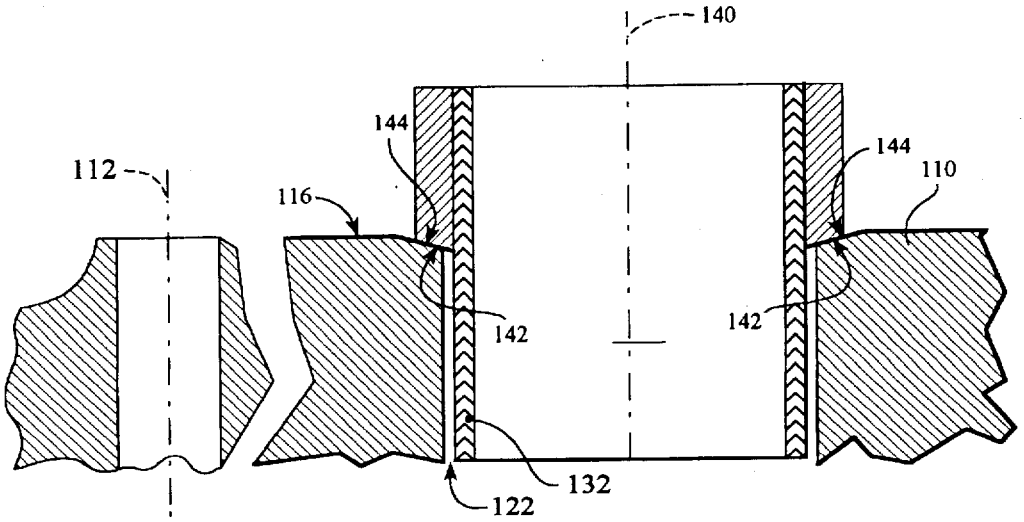
FIG. 6A is a plan view, in partial cross-section, of a rotor body in accord with an alternate embodiment showing a position of a centrifuge container within a bore of the rotor body when the rotor body is at rest.

Referring to FIG. 6A, an alternate embodiment of the present invention is disclosed which may be employed in either a fixed-angle rotor or a vertical-tube rotor, but is discussed with respect to a vertical-tube centrifuge rotor for clarity. In the vertical-tube centrifuge rotor, the lengthwise axis 140 of each container extends parallel to the spin axis 112. The load bearing surface 144 of the first major surface 116, against which the shoulder 142 rests, is beveled to have a frusto-conical shape and extends from the first major surface 116, inwardly and downwardly toward the lengthwise axis 140. The shoulder 142 is provided with a complementary shape. To that end, the shoulder 142 forms a frusto-conical surface extending from the receptacle 132, upwardly and outwardly. The entire circumference of the shoulder 142 is seated against the load bearing surface 144 when the rotor body 110 is at rest. This configuration forms a ramp feature between the load bearing surface 144 and the shoulder 142, which allows a portion of the shoulder 142 to be spaced-apart from the rotor body 110 during centrifugation, discussed more fully with respect to FIG. 6B.

Figure 6B:
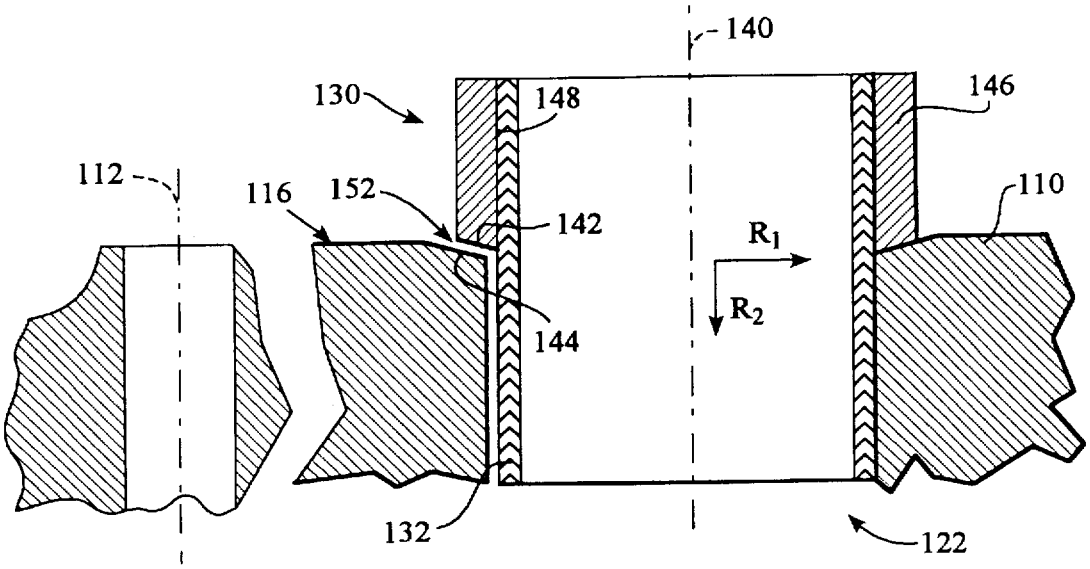
FIG. 6B is a plan view, in partial cross-section, of the rotor body shown in FIG. 5A demonstrating the position of the centrifuge container with respect to the bore during centrifugation.

During centrifugation, as shown in FIG. 6B, the $R_1$ component of the force causes the centrifuge container 130 to move away from the spin axis 112. As the container 130 moves away from the spin axis 112, the container 130 moves upwardly, in a direction parallel to the lengthwise axis 140, a sufficient distance to form a void 152 between the shoulder 142 and the load bearing surface 144. The void 152 is located between the receptacle 130 and the spin axis 112. To that end, the cross-sectional area of the receptacle 130 is smaller than the cross-sectional area of the bore 122, thereby allowing the receptacle 130 to move therein. With this design, the delamination of the sleeve 146 and the receptacle 132 at the inner region 148 of the sleeve-receptacle interface is avoided.

Figure 7:
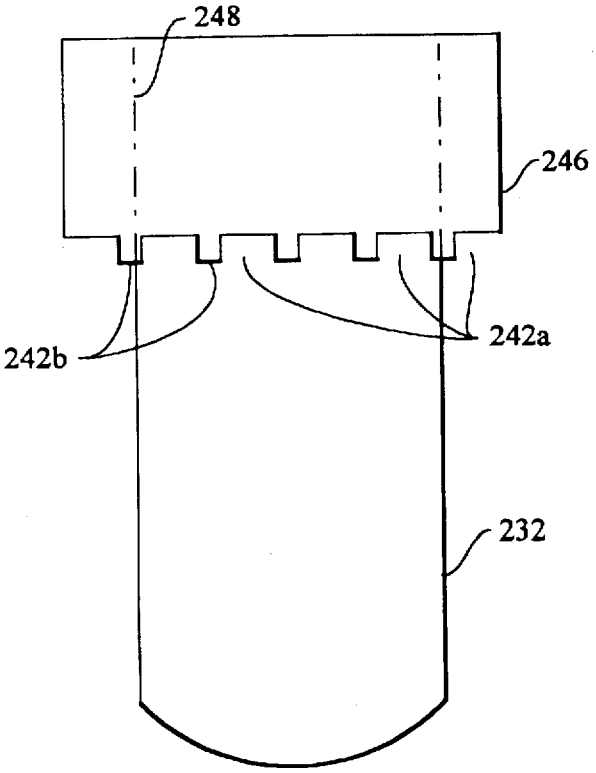
FIG. 7 is a side view of an alternate embodiment of the centrifuge container, shown in FIG. 1, that may be used in accord with the present invention.

Referring to FIGS. 1 and 7, an alternate embodiment of the centrifuge container is shown with the shoulder having a plurality of recessed areas **242*a* formed therein. Each recessed area 242*a* is located between a support portion 242*b*, which are disposed to contact the load bearing surface 44 of the first major surface 16. The recessed areas 242*a* form voids between the shoulder and the rotor body 10, reducing the stress on the inner region 248 of the sleeve-receptacle interface, as discussed above. The recessed areas 242*a* should be positioned to coincide with the locus 50. In this fashion, delamination of the metal sleeve 246 and the receptacle 232 may be avoided in either a fixed-angle or vertical-tube centrifuge rotor. However, to avoid alignment problems, it is preferred that the recess areas 242*a*** be formed periodically about the entire circumference of the shoulder.

We claim:

1. In combination a centrifuge rotor and a removable loosely fitting sample container for receiving and holding a sample to be centrifuged, said combination comprising:

a sample container open at the top, closed at the bottom and extending along a lengthwise axis, said container having a shoulder protruding therefrom near an open end; and a rotor body having a spin axis and first and second opposed major surfaces, a plurality of radially spaced bores formed in said first major surface, symmetrically about said spin axis and extending toward said second major surface, for receiving said sample container, with said shoulder of said sample container seating against said first major surface of said rotor body adjacent to one of said plurality of bores to define a shoulder-rotor interface, said shoulder-rotor interface including a void defined in the region of said interface disposed between said container and said spin axis, whereby stresses exerted on said shoulder during centrifugation are reduced.

2. The combination of claim 1 wherein the outer diameter of said sample container is smaller than the diameter of said one of said plurality of bores and the edge of said first major surface surrounding said one bore and the edge of said shoulder are each beveled to form a frusto-conical shaped shoulder to rotor interface, whereby said container moves outwardly and upwardly during centrifugation to form said void.

3. The combination of claim 1 wherein said first major surface surrounding said one of said plurality of bores includes a recess, with said void being defined between said shoulder and said recess.

4. The combination of claim 1 wherein said shoulder includes a recess facing said first major surface surrounding said one of said plurality of bores, with said void being defined by said recess and said surface.

5. The centrifuge rotor as recited in claim 1 wherein each of said plurality of bores is oriented so said lengthwise axis forms an oblique angle with respect to said spin axis when said container is disposed therein.

6. The centrifuge rotor as recited in claim 1 wherein each of said plurality of bores is oriented so said lengthwise axis extends parallel to said spin axis when said container is disposed therein.

7. The centrifuge rotor as recited in claim 1 wherein each of said plurality of bores and said container have a circular cross-section.

8. In combination a centrifuge rotor and a removable loosely fitting sample container for receiving and holding a sample to be centrifuged, said combination comprising:

a plurality of sample containers open at the top, closed at the bottom and extending along a lengthwise axis, each of said containers having a shoulder protruding therefrom near an open end; and a rotor body having a spin axis and first and second opposed major surfaces, a plurality of radially spaced bores formed in said first major surface, symmetrically about said spin axis and extending toward said second major surface, for receiving said sample containers, with said shoulder of said sample containers disposed adjacent to said first major surface of said rotor body surrounding said bores to define a shoulder-rotor interface, said shoulder-rotor interface including a void defined in the region of said interface disposed between said container and said spin axis, whereby stresses exerted on said shoulder during centrifugation are reduced.

9. The combination of claim 8 wherein said shoulder-rotor interface includes an annular washer having opposed first and second surfaces, with said first surface being substantially planar and seating adjacent to said surface surrounding said bores, said second surface having a recess and facing said shoulder, with said recess defining said void.

10. The combination of claim 8 wherein the outer diameter of said sample containers is smaller than the diameters of said bores and the edge of said first major surface surrounding said bores and the edge of said shoulder are each beveled to form a frusto-conical shaped shoulder to rotor interface, whereby said container moves outwardly and upwardly during centrifugation to form said void.

11. The combination of claim 8 wherein said first major surface surrounding said bores includes a recess, with said void being defined between said shoulder and said recess.

12. The combination of claim 8 wherein said shoulder includes a recess facing said first major surface surrounding said bores, with said void being defined by said recess and said surrounding surface.

13. The centrifuge rotor as recited in claim 8 wherein each of said plurality of bores is oriented so said lengthwise axis forms an oblique angle with respect to said spin axis when said container is disposed therein.

14. The centrifuge rotor as recited in claim 8 wherein each of said plurality of bores is oriented so said lengthwise axis extends parallel to said spin axis when said receptacle is disposed therein.

15. In combination a centrifuge rotor and a removable loosely fitting sample container for receiving and holding a sample to be centrifuged, said combination comprising:

a sample container open at the top, and closed at the bottom and extending along a lengthwise axis, said container having a circular cross-section and an annular shoulder protruding therefrom near an open end; and a rotor body having a spin axis and first and second opposed major surfaces, a plurality of radially spaced cylindrical bores formed in said first major surface, symmetrically about said spin axis and extending toward said second major surface, for receiving said sample container, with said shoulder of said sample container disposed adjacent to said first major surface of said rotor body surrounding one of said plurality of bores to define a shoulder-rotor interface, said shoulder-rotor interface including a void defined in the region of said interface disposed between said container and said spin axis, whereby stresses exerted on said shoulder during centrifugation are reduced.

16. The centrifuge rotor as recited in claim 15 wherein said shoulder has a depth measured normal to said receptacle, with a width of said recessed portion, measured parallel to a direction radial with respect to said spin axis, being at least a large as said depth of said shoulder.

17. The combination of claim 16 wherein said shoulder-rotor interface includes an annular washer having opposed first and second surfaces, with said first surface being substantially planar and seating adjacent to said surface surround said one of said plurality of bores, said second surface having a recess and facing said shoulder with said recess defining said void.

18. The combination of claim 16 wherein said first major surface surrounding said one of said plurality of bores includes a recess, with said void being defined between said shoulder and said recess.

19. The combination of claim 16 wherein said shoulder includes a recess facing said first major surface surrounding said one of said plurality of bores, with said void being defined by said recess and said surface.

20. The combination of claim 15 wherein the outer diameter of said sample container is smaller than the diameter of said one of said plurality of bores and the edge of said first major surface surrounding said one of said plurality of bores and the edge of said shoulder are each beveled to form a frusto-conical shaped shoulder to rotor interface, whereby said container moves outwardly and upwardly during centrifugation to form said void.

* * * * *